US011148002B2

(12) United States Patent
Wittenbrink

(10) Patent No.: US 11,148,002 B2
(45) Date of Patent: Oct. 19, 2021

(54) ATHLETIC TRAINING BOX

(71) Applicant: Christopher H Wittenbrink, Woodinville, WA (US)

(72) Inventor: Christopher H Wittenbrink, Woodinville, WA (US)

( * ) Notice: Subject to any disclaimer, the term of this patent is extended or adjusted under 35 U.S.C. 154(b) by 35 days.

(21) Appl. No.: 16/777,984

(22) Filed: Jan. 31, 2020

(65) Prior Publication Data

US 2020/0246657 A1 Aug. 6, 2020

Related U.S. Application Data

(60) Provisional application No. 62/799,711, filed on Jan. 31, 2019.

(51) Int. Cl.
*A63B 21/00* (2006.01)
*A63B 6/00* (2006.01)
*A63B 5/16* (2006.01)

(52) U.S. Cl.
CPC ..... *A63B 21/4033* (2015.10); *A63B 5/16* (2013.01); *A63B 6/00* (2013.01)

(58) Field of Classification Search
CPC ... A63B 21/4033; A63B 6/00; A63B 71/0054; A63B 2071/00603; A63B 5/16
See application file for complete search history.

(56) References Cited

U.S. PATENT DOCUMENTS 3,262,134 A * 7/1966 Bramble, Jr. ..... A63B 6/00 5/420
3,995,846 A * 12/1976 Frick ..... A61F 15/005 5/646
4,357,725 A * 11/1982 Ahlm ..... A47C 27/14 5/740
4,873,734 A * 10/1989 Pollard ..... A47C 21/08 5/425
4,968,025 A * 11/1990 Edkins ..... A63B 3/00 482/23
5,472,390 A * 12/1995 Faye ..... A63B 23/0458 482/27
5,639,072 A * 6/1997 McCall ..... A47B 95/043 248/345.1
8,287,437 B1 * 10/2012 Rovere ..... A63B 71/08 482/83
9,480,870 B2 * 11/2016 Januszek ..... A63B 23/0458
10,695,608 B2 * 6/2020 Engelfried, Jr. ... A63B 21/4043
10,828,523 B2 * 11/2020 Briggs ..... A63B 21/00047
2015/0231436 A1 * 8/2015 Januszek ..... A63B 6/00 482/142
2017/0043201 A1 * 2/2017 Januszek ..... A63B 5/00
2017/0050101 A1 * 2/2017 Ruscombe-King ..... A63B 21/00047
2017/0056745 A1 * 3/2017 Stacey ..... A63B 21/0084
(Continued)

*Primary Examiner* — Andrew S Lo
(74) *Attorney, Agent, or Firm* — Paul B. Heynssens; Attorney at Law, PLC

(57) ABSTRACT

An athletic training box that includes firm planar surfaces that transition to soft edges. On the outer surface of the athletic training box the soft edges transition directly from the outer surface into a rounded foam edge without a ridge, or substantial obstacle being presented to cause a safety hazard. An internal frame structure is provided within the athletic training box to support the planar surfaces receiving the force of the jump while also maintaining the "square" 90 degree angles, and thus the parallel jump surfaces of the athletic training box.

15 Claims, 13 Drawing Sheets

(56) References Cited

U.S. PATENT DOCUMENTS

| | | | | |
|---|---|---|---|---|
| 2017/0172331 | A1* | 6/2017 | Publicover | A63B 26/003 |
| 2018/0229098 | A1* | 8/2018 | McCorkle | A63B 71/0054 |
| 2018/0271735 | A1* | 9/2018 | Drucker | A63B 21/00047 |
| 2019/0009121 | A1* | 1/2019 | Briggs | A63B 21/4027 |
| 2019/0336813 | A1* | 11/2019 | Park | A63B 23/0458 |
| 2021/0052936 | A1* | 2/2021 | Park | A63B 21/00047 |

* cited by examiner

Athletic
Training
Box
100

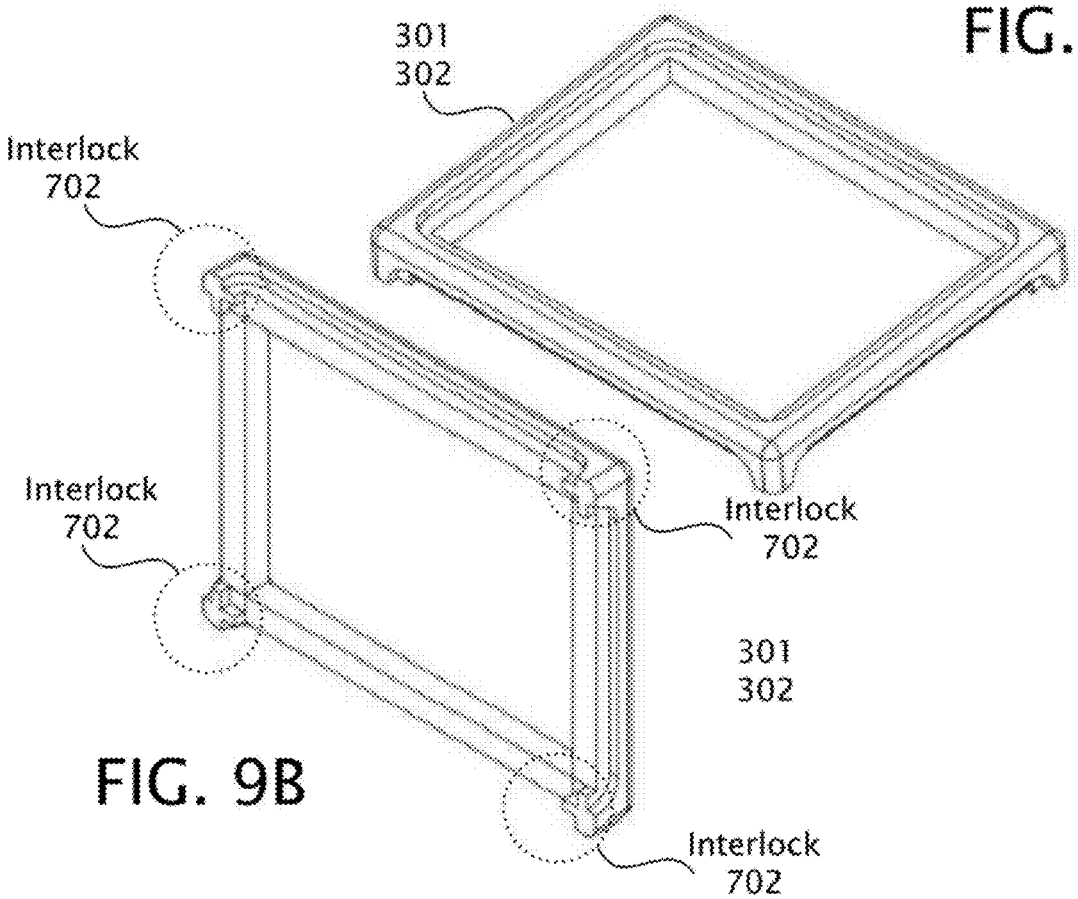
FIG. 9A
FIG. 9B
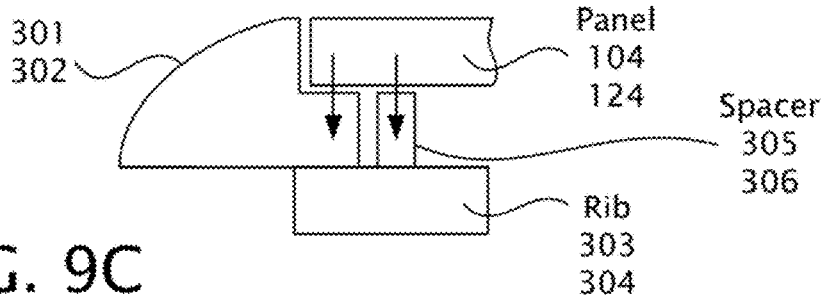
FIG. 9C

1300

| Hardness, Asker C | Specific Gravity | Density (kg/m3) | Tensile Strength (kg/cm2) | Ultimate Elongation (%) | Tear Strength (kg/cm) | Split Tear (kg/cm) | Compression Set (%) | Temperature Range (f) Low to High | Shrinkage (%) | Rebou nd(%) | Accelerated Aging (24 hours at 70C) |
|---|---|---|---|---|---|---|---|---|---|---|---|
| ASTM D2240 | ASTM D297 | ASTM D3575 | ASTM D412 | ASTM D412 | ASTM D624 | BS 5131 | ASTM D395 | 70 C, 40mins | 70 C, 40mins | ASTM D2632 | ASTM D1140 |
| 2C +/- | 0.02 +/- | Minimum | Minimum | Minimum | Minimum | Minimum | Maximum | Maximum | Maximum | | Without cracking |
| 60+/-2C | 0.22 | 0.22 | 28 | 250 | 15.1 | 2.2 | 58 | 70 C | 2.1 | 47 | pass |

FIG. 13

ATHLETIC TRAINING BOX

CROSS-REFERENCE TO RELATED APPLICATION

This application claims the benefit of U.S. Provisional Patent Application No. 62/799,711 filed Jan. 31, 2019, the contents of which are hereby incorporated by reference.

TECHNICAL FIELD

This description relates generally to exercise equipment and more specifically to jump box equipment.

BACKGROUND

Changes in height may be used to improve strength and endurance, by expending energy in changing the height of one's body. Walking up stairs is known to be good exercise and has inspired the invention of stair climbing machines. Likewise, aerobic exercise routines may make use of a low platform to aid increasing the energy expended in a session by repeatedly stepping on and off the platform.

In more aggressive athletic training, jumping (as opposed to stepping) on and off of a box may be used to exercise. The box may be knee high height and is typically made of heavy wood to withstand the force of someone jumping on top of it. The edges of the outer surface provide the assembly points of the box sides as well as the surface the user encounters in a jump. Such "jump boxes" may be formed as right rectangular prisms and thus have sharp corners that can cause injury if the jump is missed, or if the user falls off.

In an effort to minimize injury, sometimes such boxes are supplied with an external foam cover or covering. However, while the edges are padded the flat surfaces one jumps upon are padded, not providing the best footing for the person jumping upon such a surface. Covering the exterior has not proved satisfactory.

Alternatively, the entire box may be made of foam (a block) or other softer material. Again, the sharpness of edges is lessened, but firmness of footing is lessened on the surfaces. Also, such blocks, made entirely of a foam material tend to be expensive.

Accordingly, it would be desirable to provide a jump box that is inexpensive to produce, and provides firm footing surface for the user executing a successful jump, while providing soft edges to minimize injury in jumps gone wrong.

SUMMARY

The following presents a simplified summary of the disclosure in order to provide a basic understanding to the reader. This summary is not an extensive overview of the disclosure and it does not identify key/critical elements of the invention or delineate the scope of the invention. Its sole purpose is to present some concepts disclosed herein in a simplified form as a prelude to the more detailed description that is presented later.

An athletic training box includes six sides defining a right rectangular prism envelope, and each side having an opposite parallel jump face. Each parallel jump face may be supported by a unique structure including an internal frame. Each jump face need not intersect its adjacent face, as support is substantially provided by the internal frame. Gaps between adjacent faces may be filled by typically rounded foam corners.

The present example provides an athletic training box that includes firm planar surfaces that transition to soft edges. On the outer surface of the athletic training box the soft edges transition directly from the outer surface into a rounded foam edge without a ridge, or substantial obstacle being presented to cause a safety hazard. An internal frame structure is provided within the athletic training box to support the planar surfaces receiving the force of the jump while also maintaining the "square" 90 degree angles, and thus the parallel jump surfaces of the athletic training box.

Many of the attendant features will be more readily appreciated as the same becomes better understood by reference to the following detailed description considered in connection with the accompanying drawings.

DESCRIPTION OF THE DRAWINGS

The present description will be better understood from the following detailed description read in light of the accompanying drawings, wherein:

FIGS. 9A and 9B show additional details of the foam edges.

FIG. 9C shows a cross section of the foam frame assembled with a panel and the interior spacer.

FIG. 13 shows the exemplary properties of foam suitable for use in the athletic training box examples herein.

Like reference numerals are used to designate like parts in the accompanying drawings.

DETAILED DESCRIPTION

Figure 1:
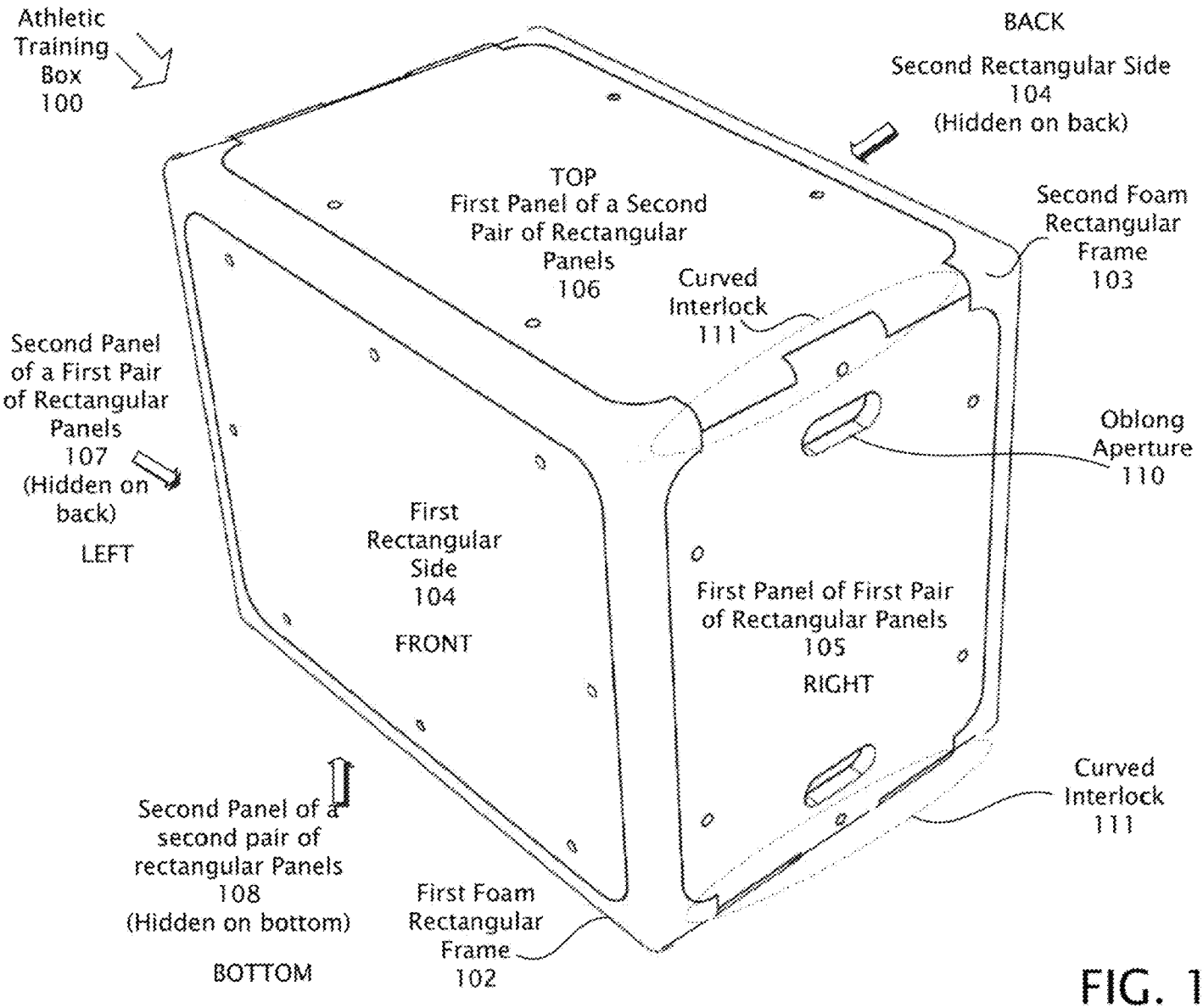
FIG. 1 shows a front incline view of an athletic training box including integral foam corners.

The detailed description provided below in connection with the appended drawings is intended as a description of the present examples and is not intended to represent the only forms in which the present example may be constructed or utilized. The description sets forth the functions of the example and the sequence of steps for constructing and operating the example. However, the same or equivalent functions and sequences may be accomplished by different examples.

The examples below describe an athletic training box. Although the present examples are described and illustrated herein as being implemented in a cross fit training system, the system described is provided as an example and not a limitation. As those skilled in the art will appreciate, the present examples are suitable for application in a variety of different types of exercise systems.

A form of exercise called "box jumps" typically involves jumping on and off a box (a right rectangular prism in shape). This exercise is frequently encountered in cross fit training, and other types of athletic training such as plyometrics or the like.

Plyometrics, jump training or plyos, are typically exercises in which muscles exert force in a short interval of time, with the goal of increasing speed and strength. This training tends to focus on learning to move from a muscle extension to a contraction in a rapid or "explosive" manner, such as in specialized repeated jumping. Plyometrics are typically used by athletes, especially cross fit trainers, martial artists, sprinters, high jumpers, and the like to improve performance, and may also be used in the general fitness field to a somewhat lesser degree.

One of the pieces of equipment used in polymetrics and cross fit training is called a "plyo box". It is simply a box for jumping onto and a standard size is typically 30"×24"×20", with hard square corners and edges, as are encountered in a typical box. In such a plyo box the corners and edges are also the structural support for the box, as the various sides of the box attaché to each other along the edge with screws or the like.

The plyo box can be set at the different heights simply by flipping the plyo box to the needed height for a particular workout or ability. Currently available boxes are typically either made entirely from plywood (most popular style in use) or entirely from foam and padding (not as well liked or as common, and also quite a bit more expensive).

Unfortunately, athletes can sometimes slip off of the plyo box, scraping their legs. Sometimes the athlete can even lose their footing and fall on the box. To say the least this can be painful, and even more painful if one falls on an edge or corner of the box. Typically a conventional plyo box with hard right angled edges is used in box jump training. In order to prevent injury, a specially constructed athletic training box that tends to reduce injury has been invented, and is described herein.

Characteristics that make the athletic training box a better product include:

1. The plywood construction of the flat surfaces of the athletic training box is preferred by athletes for stability and feel when jumping.
2. The athletic training box can be shipped knock-down and assembled by end user in about 10 minutes.
3. The soft corners of the athletic training box tend to prevent serious injury when a jump is ultimately missed at some point in training.
4. The weight of the athletic training box is a little less than the most popular plywood boxes, which tends to be light enough for reasonable shipping, yet heavy enough to be stable.
5. The foam parts of the athletic training box are available as replacement parts and the plywood parts are reusable. Accordingly there will be a service and refurbishment market for worn out foam to be replaced relatively inexpensively without replacing the whole box.

Construction that makes the athletic training box unique:

1. Integrated, rounded foam corners on the athletic training box.
2. Perforated plywood panels for a unique look and reduced weight of the athletic training box.
3. Internal bracing to support the side panels and maintain the shape of the athletic training box, and taking structural loading away from the corners so that soft materials may replace hard edges and corners.

The athletic training box takes the fear out of box jumps so an athlete can focus on their workout. Assembly is very easy—about 10 minutes. The athlete may save their shins and a possible trip to the emergency room because of the construction of the athletic training box. Athletic training box edges are typically made with a rounded but firm, slightly compressible closed cell molded foam that typically will protect an athlete or a trainer's client from serious injury in the event of a fall or missed jump.

A typical box with right angle corners has faces that are supported and made rigid by the joints are the corners where the various surfaces are joined together. Such sharp edges and corners can cause injury when a body impacts them such as in a fall or slip, as might happen when jumping on or off the box. The athletic training box design uniquely utilizes an internal support structure to provide strong support to the planar surfaces upon which an athlete jumps upon-removing the need to have the box edges act as support structures. Since the 12 edges of the box no longer are weight bearing they do not need to be connected or joined in order to maintain rigidity of the six faces of the box (as support is provided by the internal structure). However, to prevent scrapes and injury the corners and edges of the box are filled with an impact absorbing material that may be rounded to further lessen impact in case of a fall. The structure of the athletic training box is unique in that its rigidity is not principally provided by the edges, but rather by its internal support structure.

FIG. 1 shows a front incline view of an athletic training box including integral foam corners. The front incline view is identical to the rear incline view, with the location of the hidden surfaces 107, 108, 124 indicated by arrows. The athletic training box 100 is typically in the overall shape of a right rectangular prism, or even a cube, with rounded edges. The proportions of the generally rectangular panels or surfaces 104, 105, 106, 107, 108, 124 may be varied as desired to provide desired jump heights. A generally rectangular panel is understood to include a panel of rectangular shape that can have conventional square corners, rounded corners, beveled corners or the like. A generally rectangular panel may also be understood to include one or more irregular edges, including protrusions, tabs, notches and the like. A generally rectangular panel may also include one or more rounded or beveled edges.

The athletic training box 100 includes a first foam rectangular frame 102, and a second foam rectangular frame 103. A first rectangular side 104 is surrounded by the rectangular foam frame 102. A second rectangular side 124 is surrounded by the rectangular foam frame 103. The foam rectangular frames 102, 103 may be separated by a first pair of parallel rectangular panels 105, 107, and a second set of parallel rectangular panels 106, 108, with each pair of panels being disposed opposite from each other, or stated another way with the flat sides of the panel sets in parallel orientation to each other.

The first pair of rectangular panels 107, 111 are oppositely disposed and may be coupled to the second pair of oppositely disposed rectangular panels 106, 108 by a curved interlock 111 formed into the panels. The curved interlock includes a tab formed into a panel 105 that interlocks by being positioned into a slot or groove in a mating panel 106. The outer surface of the curved interlock may be curved or rounded so that a sharp edge is not presented to a user of the athletic training box. Panels 105 and 107 are shown as square but may also equivalently be rectangular in shape.

Additionally, the panels may include rounded corners that fit into the rectangular frames 102, 103 as shown.

Uniquely the athletic training box includes an interior support structure described in the following paragraphs, that allows the panels 104, 105, 106, 107, 108, 124 to be constructed from a firm material such as plywood or the like. The internal structure allows edges that are non-load bearing to be provided. The foam edges that are made of a typically high-density foam, would not be good load bearing surfaces if the sides relied on connections along the edge of the panels. The internal construction as well as the interlocks 111 provide stability for the athletic training box and allow a soft material gentle to shins and knees to be used along the edges.

As shown in the figure apertures 110, of oblong shape or equivalent, may be disposed in the athletic training box to be used as handles. Additionally, apertures may be disposed in the panels 104, 105, 106, 107, 108, 124 to reduce weight if desired, without compromising the structural integrity of the athletic training box.

For purposes of the following projection view figure side 104 may be termed a front side, side 124 a back side, side 105 the right side, 107 the left side, 106 the top side, and 108 the bottom side.

Figures 2A, 2B, 2C:
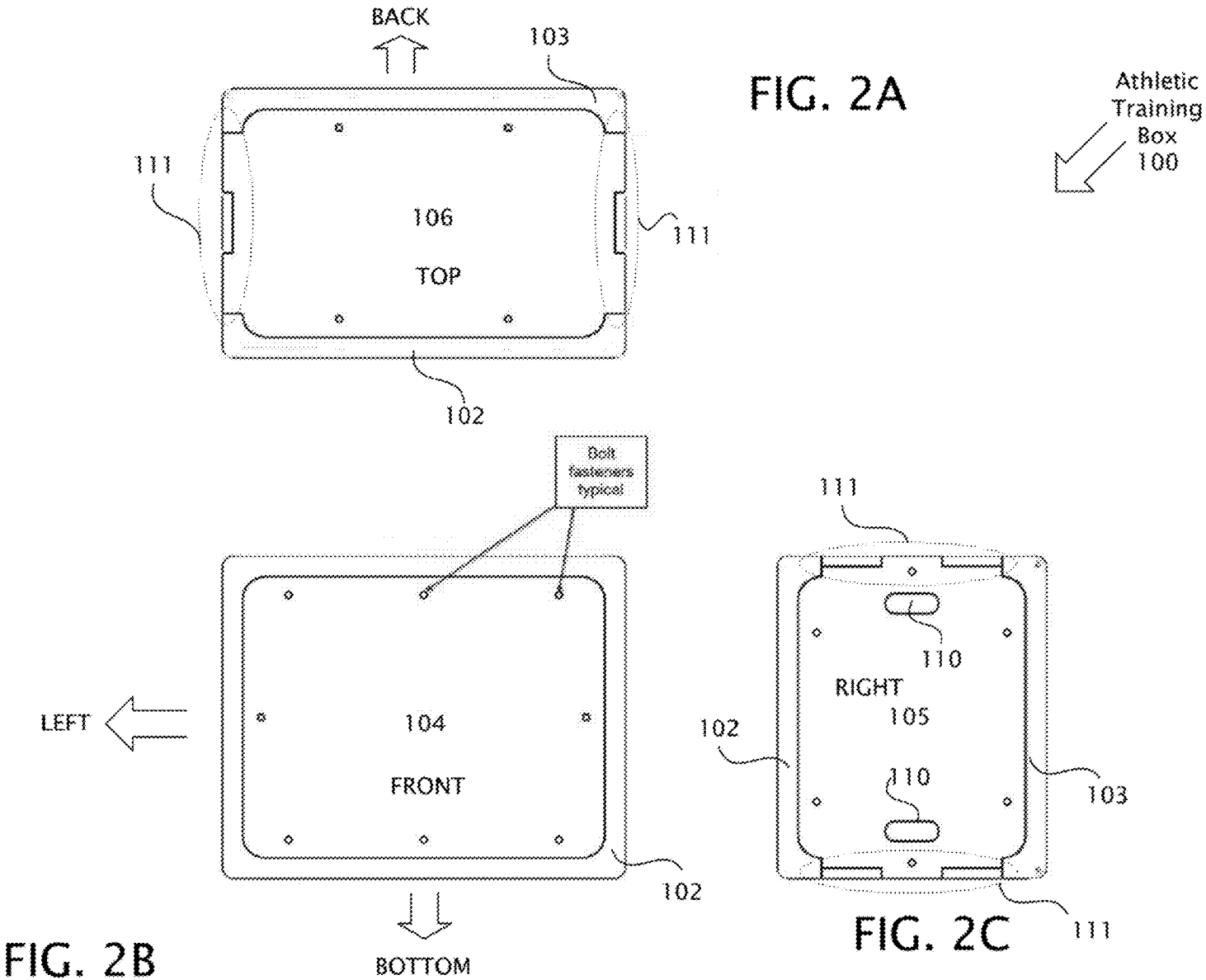
FIGS. 2A-2*c* are orthographic projection views of the athletic training box including integral foam corners.

FIGS. 2A-2*c* are orthographic projection views of the athletic training box including integral foam corners. Side 104 may be termed a front side as is identical to back side 124 which is not shown. Side 105 may be termed right side and is identical to left side 107 which is not shown. Side 106 may be termed bottom and is identical to top side 106.

In the various views the position of the foam edges 102, 103, as well as their shapes may be seen in relation to the other components. The foam edges 102, 103 may be made from an Ethylene-vinyl acetate ("EVA") foam, or equivalent material. Also shown are the curved interlock surfaces 111, and the apertures 110. Fasteners may be used to fasten the panels 104, 105, 106, 107, 108, 124 at various locations as shown.

Figure 3:
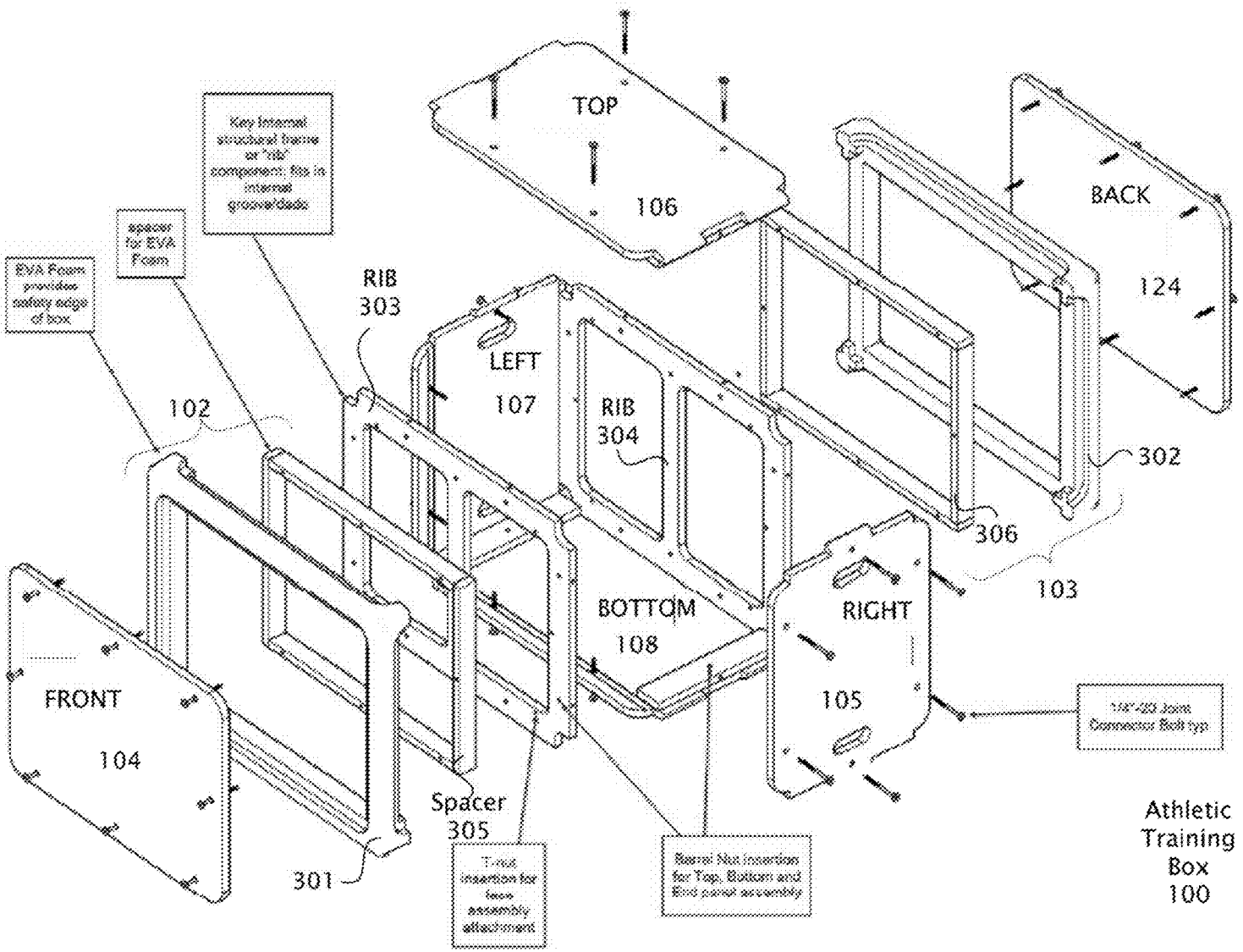
FIG. 3 is an exploded view of the athletic training box including integral foam corners.

FIG. 3 is an exploded view of the athletic training box including integral foam corners. This view shows the internal structure that provides the panel strength, while allowing soft corners and edges to be provided.

Both plywood and Ethylene-vinyl acetate ("EVA") foam, or equivalent used in the foam edges 301, 302 combined with the unique construction of the athletic training box create improved structural integrity. Panel 104, 105, 106, 107,108, 124 materials may be CNC machined from exemplary ¼" hardwood plywood or equivalent. Preferably, box construction material is an 18 mm, 9 ply, lightweight core plywood with birch face. The plywood selection makes the box typically 10 lbs lighter than most other plywood boxes on the market.

End panels 105, 107 are attached to the bottom panel 108. Ribs 303, 304 are disposed in slots or groves in the panels 108, 105, 107. Once the ribs 303, 304 are in place the top 106 may be attached to the ribs 303, 304 creating a box frame that is ready to receive the first 102 and second 103 rectangular frames. Tabs on the ends 105, 107 engage with slots on the bottom 108, and top 106 for alignment and stability. Slots in the ribs 303, 304 accept protrusions present on the rectangular frames for added structural stability.

With the frames 102, 103 in place the front 104 and back 124 panels are centered in their respective frames and attached with fasteners to their respective frames 102, 103. Notably, fasteners do not engage the foam, but rather the rigid ribs 303, 304. So that the soft EVA foam provides a soft safety edge to the box.

Frame 102 includes an EVA rubber piece 301 that is in the shape of a rectangular frame with rounded edges and is rigid enough to provide protrusions keyed to apertures in the rib 303 to which it couples. To provide further structural support a spacer (typically of wood or equivalent) frame 305 may be inserted into the foam piece 301, The spacer 301 keeps the foam piece 301 from distorting or compressing when the panel 104 is screwed down tight.

Frame 103 includes an EVA rubber piece 302 that is in the shape of a rectangular frame with rounded edges and is rigid enough to provide protrusions keyed to apertures in the rib 304 to which it couples. To provide further structural support a spacer (typically of wood or equivalent) frame 306 may be inserted into the foam piece 302, The spacer 306 keeps the foam piece 302 from distorting or compressing when the panel 1124 is screwed down tight.

Exemplary fasteners may include ¼"-20 connector bolts or the like, barrel nuts to accept the fastener, or their equivalent. In addition, T-nuts may be incorporated in the ribs 303, 304 for added strength. The ribs 303, 304 are structural members to which all of the panels 104, 105, 106, 107, 108, 124 attach so that the ribs support the top, bottom and sides of the athletic training box. The structural stability will be further explained as the construction of the athletic training box is further described in sequence.

Figure 4:
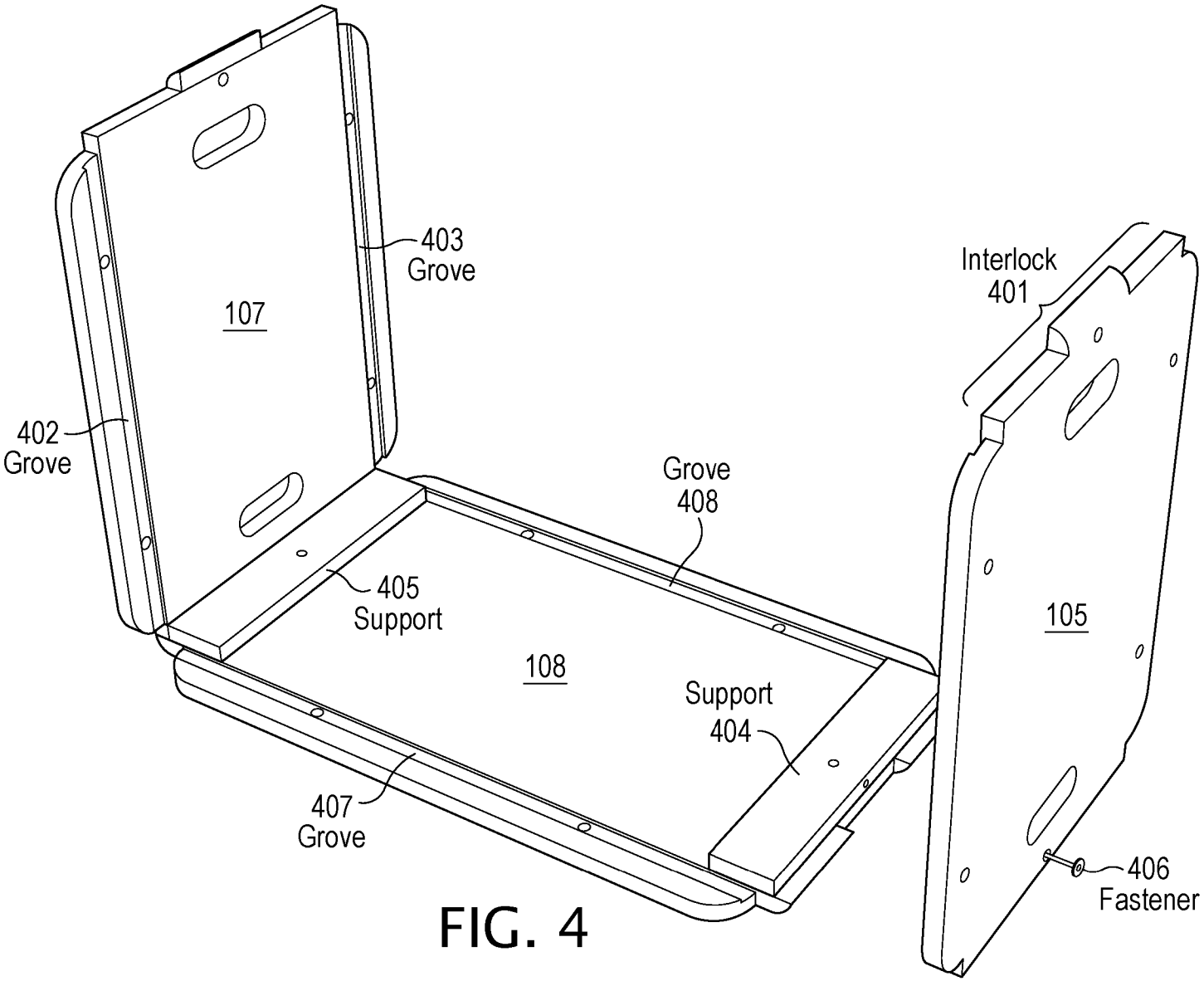
FIG. 4 shows the first stage in assembling the athletic training box.

FIG. 4 shows the first stage in assembling the athletic training box. Bottom piece 108 typically includes a pair of longitudinally disposed slots, or grooves 407, 408 along its long edge, and a pair of flat support boards 404, 405 disposed along the short end of the bottom 108. When the ends are attached to the support via a fastener (shown at one end, the other being identical) 406, the interlock area 401 at the edges of the sides 105, 107 are inserted in matching notches in the bottom 108.

Figure 5:
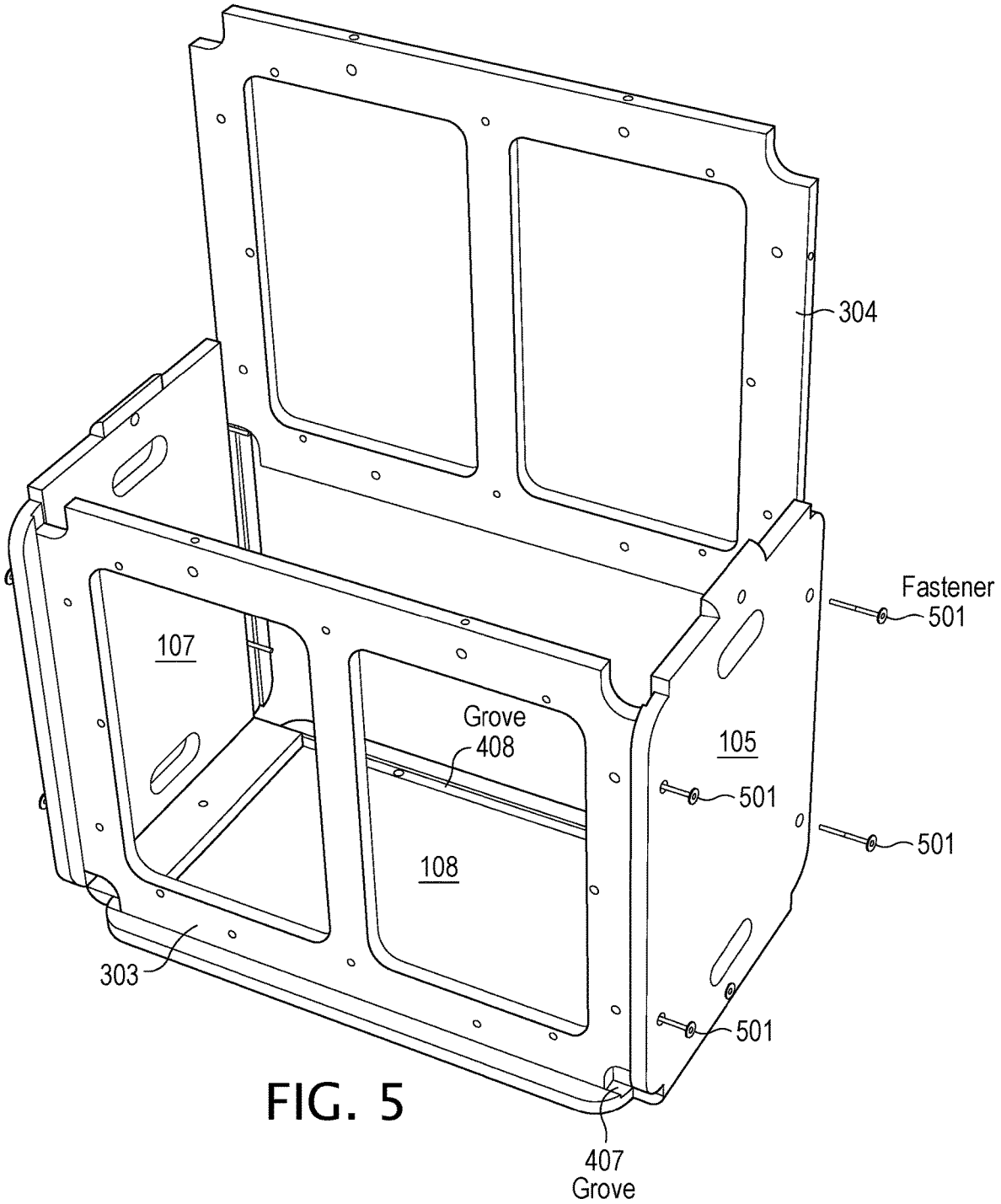
FIG. 5 shows the second stage in assembling the athletic training box.

FIG. 5 shows the second stage in assembling the athletic training box. Here the sides 107, 108, 105 have been assembled into a roughly "U" shaped piece. Ribs 303, 304 are slid into the groves in the ends 105, 107 and the bottom grooves 407, 408. A plurality of fasteners 501 are inserted into holes in the ends 105, 107 to secure the ribs to the sides and bottom.

Figure 6:
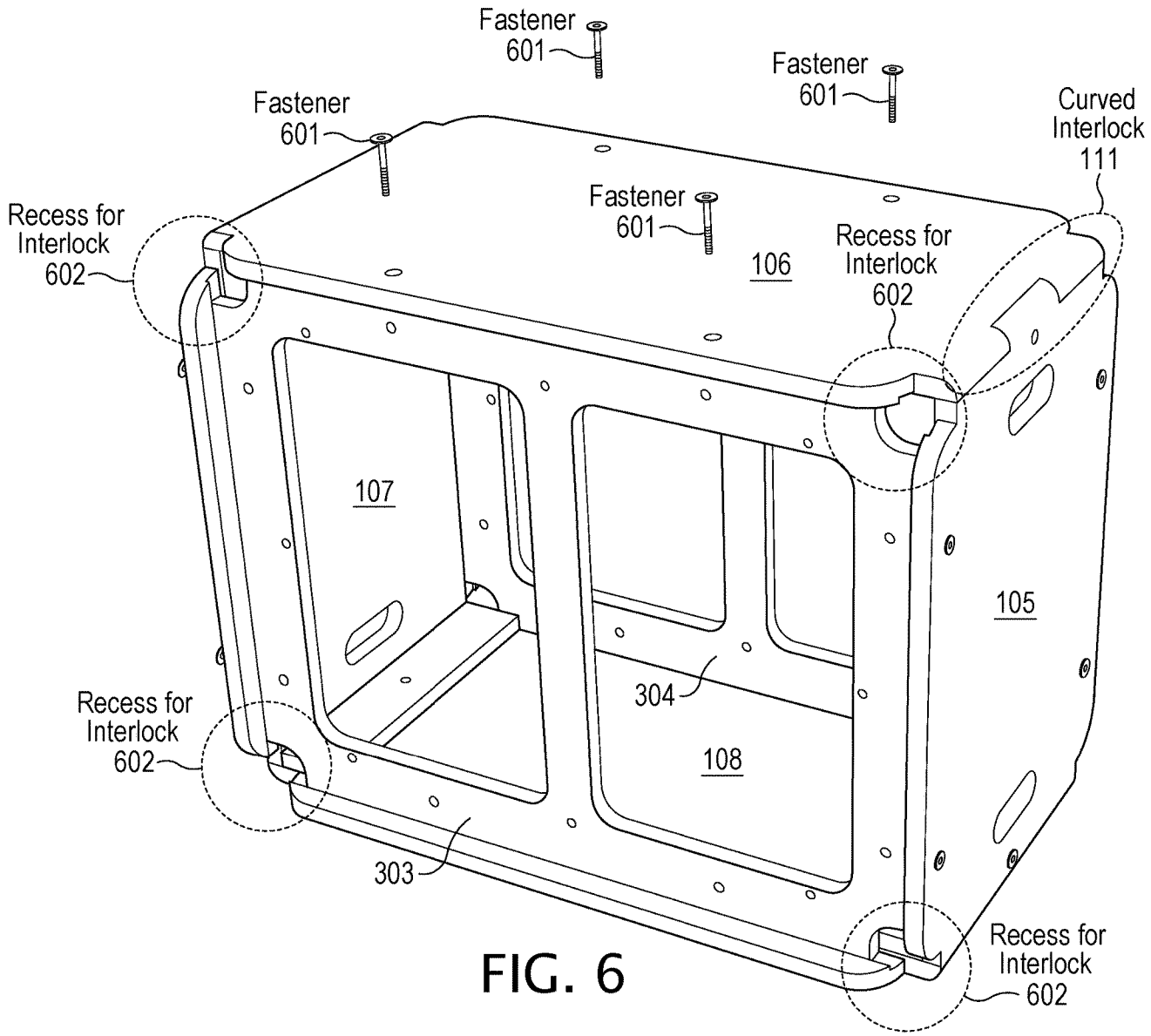
FIG. 6 shows the third stage in assembling the athletic training box.

FIG. 6 shows the third stage in assembling the athletic training box. Here the top 106 is installed attaching it to the ribs 303, 304 using a plurality of fasteners 601. At this stage the athletic training box utilizes the curved interlock 111 to help the box maintain its shape. Also, at the four corners of the ribs 303, 304 a recess has been formed by forming a notch into the corner that functions as a recess for an interlock 602.

Figure 7:
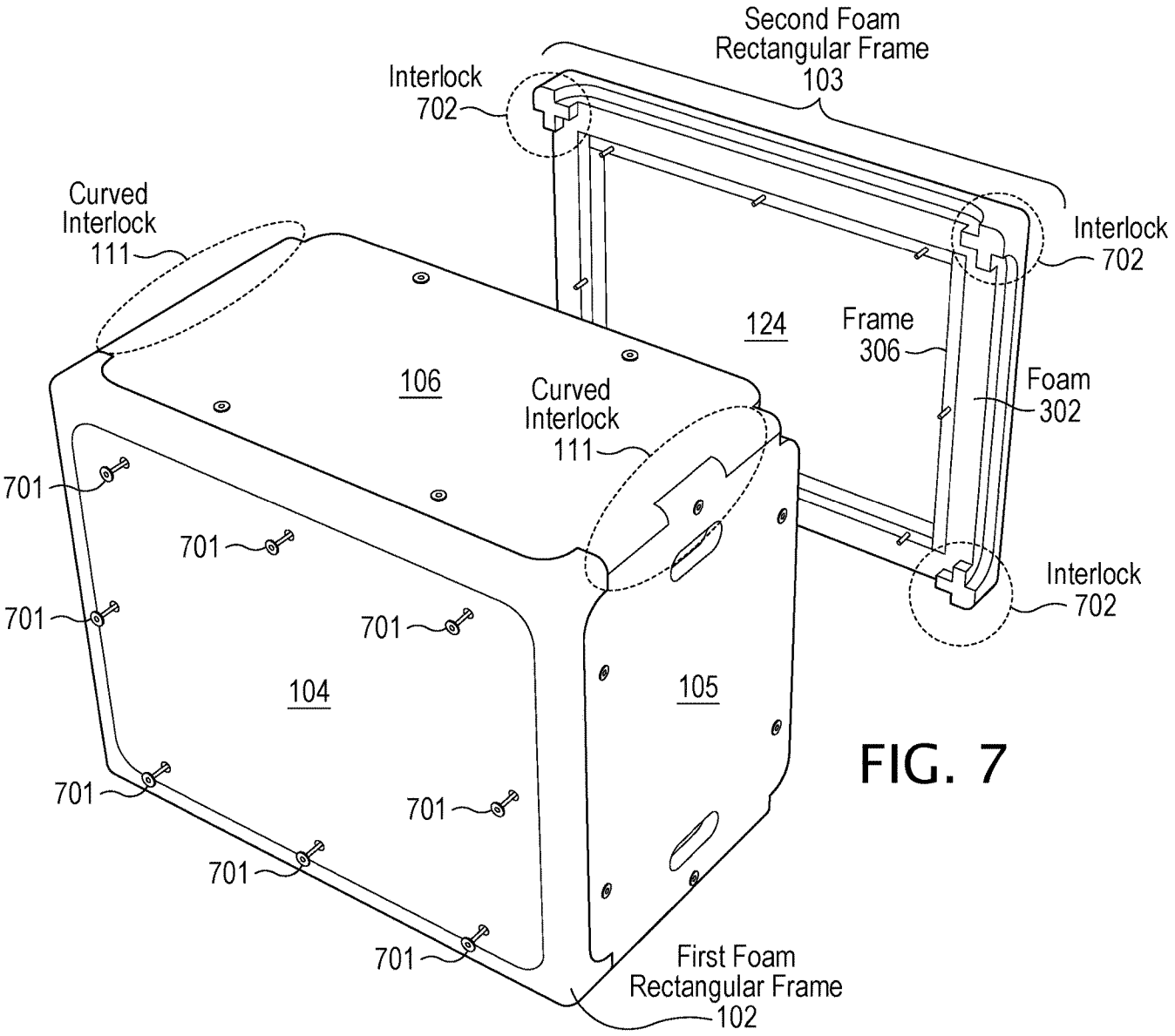
FIG. 7 shows the fourth stage in assembling the athletic training box.

FIG. 7 shows the fourth stage in assembling the athletic training box. Finally the first rectangular frame 102 and the second foam rectangular frames are assembled into the athletic training box assembled so far. The panels 104, 124 are assembled into accommodating recesses in their respective frames 102, 103. A plurality of fasteners 701 screw into the hidden ribs, fastening the foam rectangular frames 102, 103 to the previously assembled frame. All of the fasteners are tightened and the assembly of the athletic training box is complete.

On the side of the rectangular frame 103 facing outwards, second foam rectangular frame 103 includes a foam frame 302 having a recess to accommodate panel 124 so that the panel's outer surface is substantially flush with the surrounding foam 302. On the side of the rectangular frame 103 facing inwards the typically wooden frame 306 is disposed in an accommodating recess in the interior of the foam piece 302. The frame 306 prevents the foam 302 from being over compressed as the screws 701 draw the end 124 into the assembled frame. The foam includes protrusions to serve as interlocks 702 at each of the four corners. Importantly the interlocks form the soft corners of the athletic training box, and also provide a guide to align the corners by interlocking with recesses in the ribs (not shown). The opposite first foam rectangular frame 102 is similarly constructed.

Figure 8:
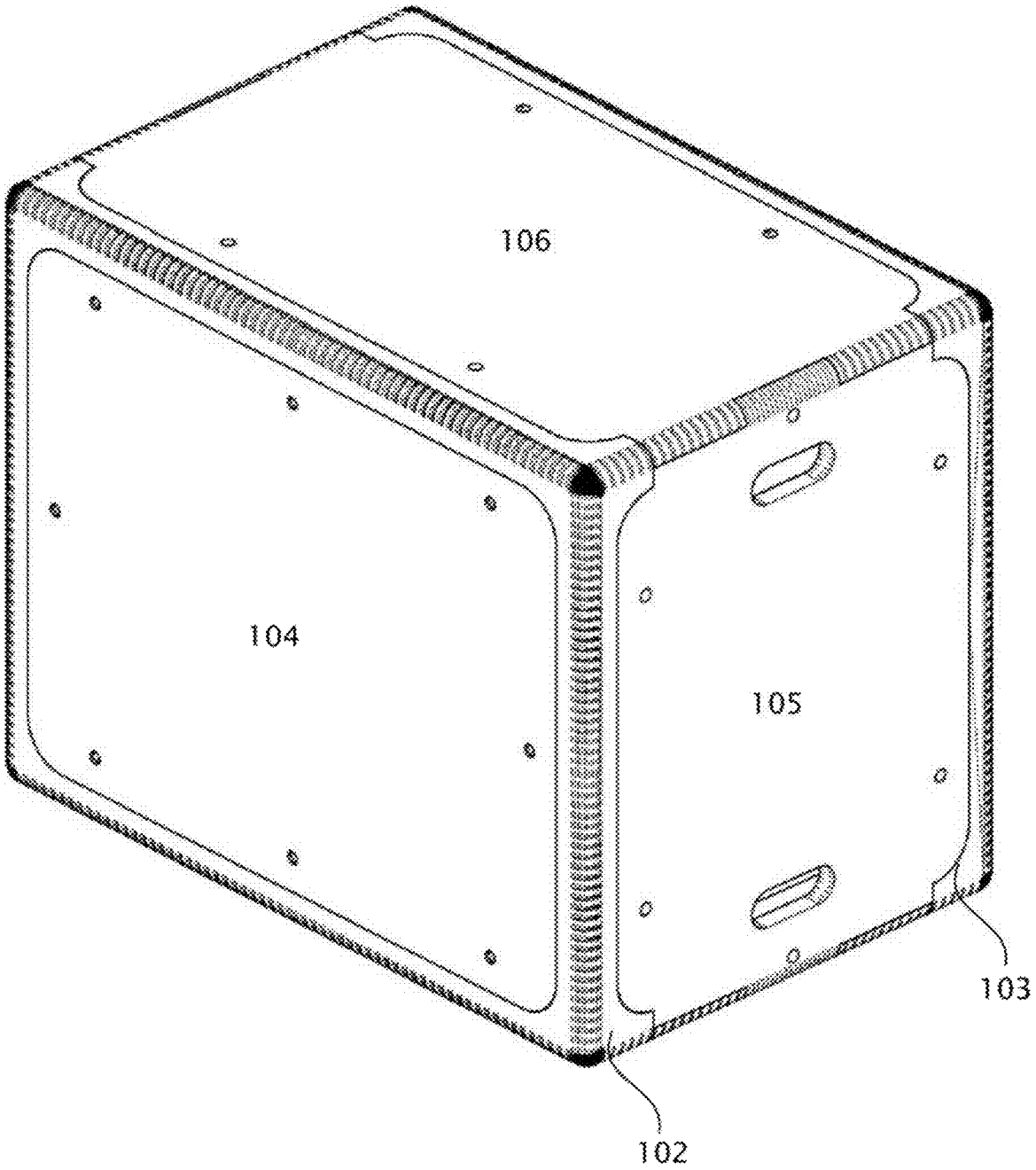
FIG. 8 shows a front incline view of the assembled athletic training box.

FIG. 8 shows a front inclined view of the assembled athletic training box. Here all of the fasteners have been finally tightened and the athletic training box is ready for use. Firm plywood or equivalent firm surfaces 104, 105, 106 (107, 108,124 not shown) are provided for a hard flat surface capable of withstanding a jump. The foam rectangular frames 102, 103 provide rounded edges and corners on the athletic training box made from a soft material that aids in preventing injury. In alternative examples the firm surfaces may include apertures to further reduce weight of the athletic training box.

FIGS. 9A and 9B show additional details of the foam edges 301, 302. The shape is that of a rectangular frame, with rounded outer edges. On a top surface of the frame a recess is formed into the frame to form a ledge upon which one of the plywood panels rests. A bottom surface of the frame a rectangular aperture is provided for an interior rigid frame, which fits against the sides of the foam frame 301, 302. Also on the bottom surface four extensions are provided that form the rounded corners of the frame 301, 302.

FIG. 9C shows a simplified cross section of the foam frame assembled with a panel and the interior spacer in place. As the panels 104, 124 are screwed into the internal rib, the bottom of the panels contact a ledge on the top surface of the foam frames 301, 302. This draws the foam frame down until the spacer 305, 306 is encountered which prevents the foam frame from being further compressed.

Figure 10:
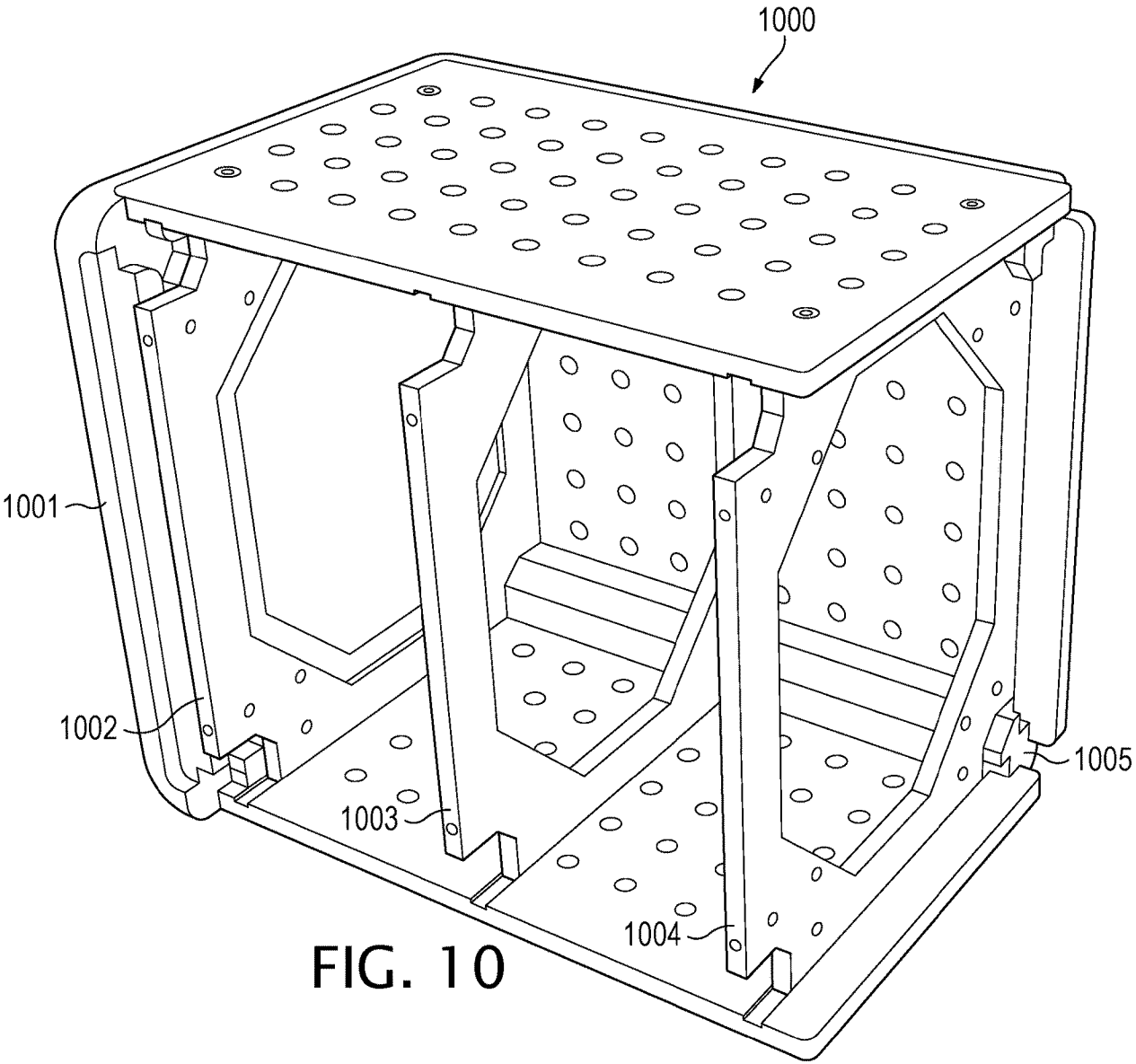
FIG. 10 shows a first alternative example of an athletic training box.

FIG. 10 shows a first alternative example of an athletic training box 1000. In this example three ribs 1002, 103, 1004 are turned 90 degrees from that of the previous example and a third rib 1003 has been added. Two ends (one 1001 is shown) are both entirely of foam. Four edges, such as exemplary edge 1005 shown fit into the ends. Again an internal support structure supports the outer panels so that structural stress is taken off of the edges, so that a soft material may be used on the edges and corners that is not load bearing.

Figure 11:
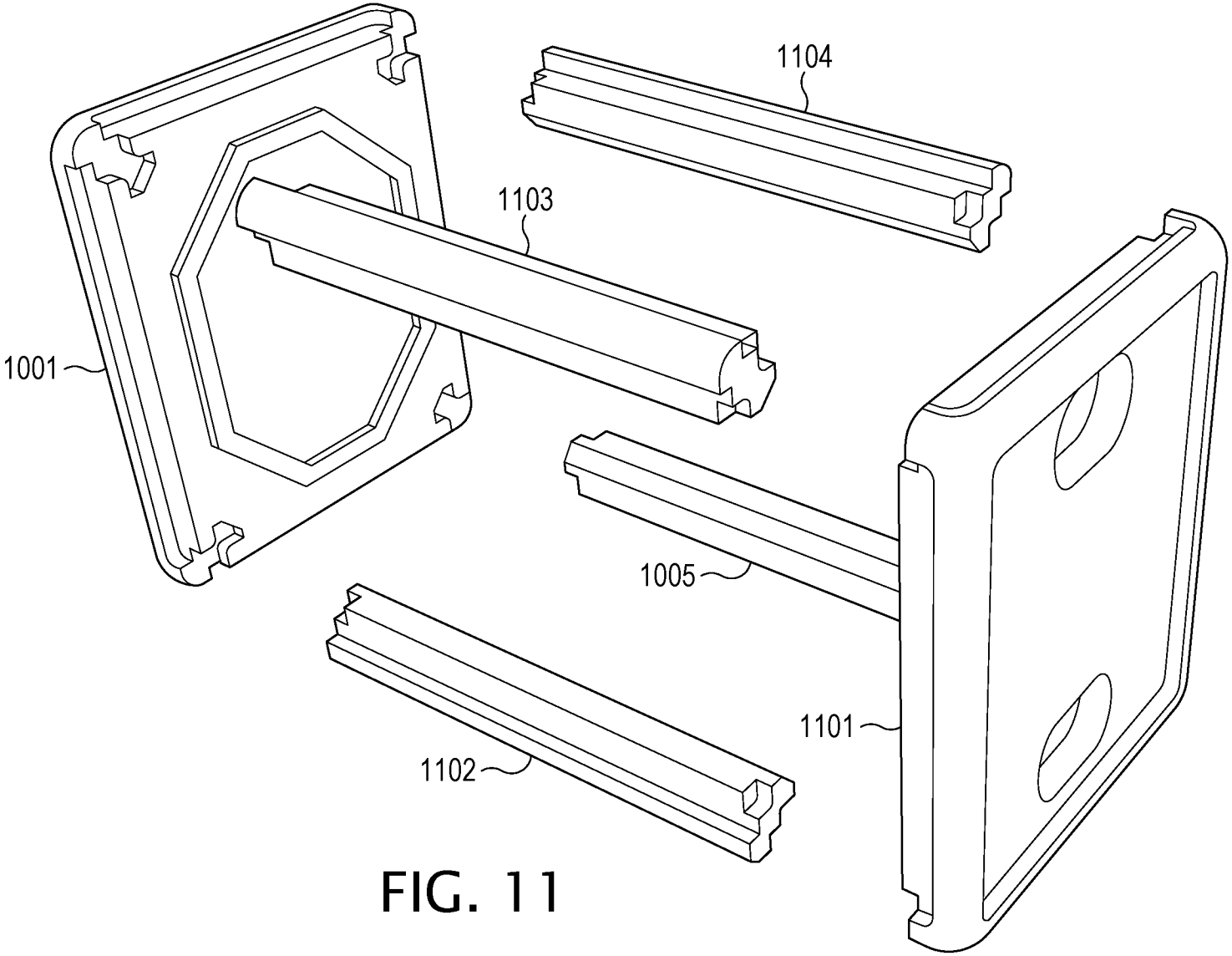
FIG. 11 shows the foam corner assembly in the first alternative example of an athletic training box.

FIG. 11 shows the foam corner assembly in the first alternative example of an athletic training box 1000. Here two foam ends identically formed 1001 are anchored to an internal rib (not shown). The rounded foam edges 1102, 1103, 1105, 1106 fit into recesses in the two foam ends 1101, and also find support from the ribs.

Figure 12:
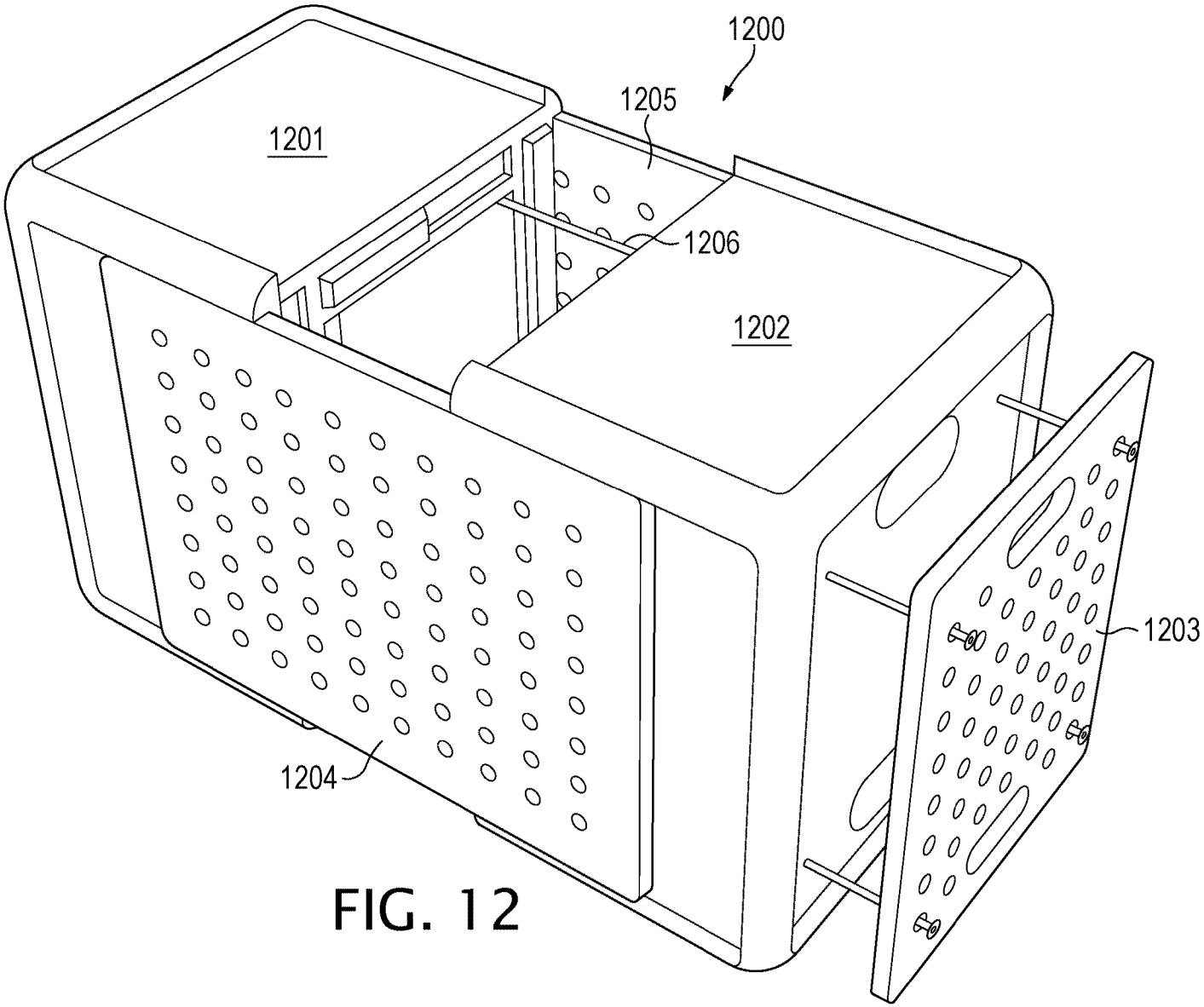
FIG. 12 shows a second alternative example of an athletic training box.

FIG. 12 shows a second alternative example of an athletic training box 1200. Here two interlocking foam cores 1201, 1202 hold the side panels 1204, 1205, two of which are show, in place. Two ends such as 1203 are placed on end recesses in the box 1200, and one or more long bolts such as 1206 extend through the assembly to a panel on the back side, As the bolts are tightened the assembly is drawn together. Here again an inner core supports the load bearing panels so that stress is relieved on the edges and corners, so that a foam material may be placed there.

In alternative examples equivalent internal support structures may be used to couple the sides and provide rigidity of the six faces. Also, a construction that provides support at the corners but allows impact absorbent material to be used along the edges is also contemplated. Further, a foam core box with interlocking plywood inserts on the sides in which the exposed corners are part of the foam core is contemplated as an alternative construction.

FIG. 13 shows the exemplary properties 1300 of foam suitable for use in the athletic training box examples herein. In general EVA material or the like may be utilized for the foam rectangular frames. Ethylene-vinyl acetate ("EVA"), also known as poly (ethylene-vinyl acetate) (PEVA), is a copolymer of ethylene and vinyl acetate. Generally the material is flexible, easy to mold, soft, and generally non-toxic.

Dedicated molds may be utilized to form the tough polypropylene edges (Expanded Polypropylene, or equivalent). The foam is extremely durable, and yet is completely replaceable in case of damage, age, wear or the like.

Those skilled in the art will realize that the process sequences described above may be equivalently performed in any order to achieve a desired result. Also, sub-processes may typically be omitted as desired without taking away from the overall functionality of the processes described above.

The invention claimed is:

1. An athletic training box comprising:

a first rectangular surface having a perimeter;

a second rectangular surface having a perimeter, and the second rectangular surface being positioned in parallel orientation to the first rectangular surface;

a first foam rectangular frame disposed around the perimeter of the first rectangular surface, having a rounded outer perimeter;

a second foam rectangular frame disposed around the perimeter of the second rectangular surface, having a rounded outer perimeter;

a first pair of rectangular panels positioned in parallel orientation to each other;

a second pair of rectangular panels positioned in parallel orientation to each other, and further oriented at right angles to the first pair of rectangular panels, with the first pair of rectangular panels, and the second pair of rectangular panels coupled to the first rectangular surface and the second rectangular surface;

a first internal rib; and a second internal rib; whereby the first foam rectangular frame is coupled to the first internal rib and the second foam rectangular frame is coupled to the second internal rib.

2. The athletic training box of claim 1 in which the first internal rib is disposed in a groove in the first pair of rectangular panels and the second internal rib is disposed in a groove in each of the second pair of rectangular panels.

3. The athletic training box of claim 1, in which the first foam rectangular frame, and the second foam rectangular frame are made from EVA.

4. The athletic training box of claim 1, in which the first internal rib, and the second internal rib are rectangular.

5. The athletic training box of claim 4, in which the first internal rib, and the second internal rib are proportional in size to the first rectangular surface.

6. The athletic training box of claim 4, in which the first rectangular surface, is the same size as the second rectangular surface;

the first foam rectangular frame is the same size as second foam rectangular frame;

each panel of the first pair of rectangular panels are the same size; and each panel of the second pair of rectangular panels are the same size.

7. The athletic training box of claim 1 in which the first rectangular surface couples the first foam rectangular frame to the first internal rib; and the first rectangular surface couples the first foam rectangular frame to the first internal rib.

8. The athletic training box of claim 1 in which a plurality of fasteners extend through the first rectangular surface into the first internal rib, and through the second rectangular surface into the second internal rib.

9. An athletic training box comprising:

a front panel generally rectangular in shape;

a back panel identical to the front panel;

a top panel generally rectangular in shape and having two opposite shorter rounded edges each shorter edge having a notch disposed in the middle of the top panel, a top surface being rounded and a bottom surface including parallel grooves, each groove disposed adjacent to each of two longer edges;

a bottom identical to the top panel;

a right end panel generally rectangular in shape and having two opposite shorter rounded edges each shorter edge having a tab disposed in the middle of the right end panel, and being rounded on a top side, and having a bottom surface including parallel grooves, each groove disposed adjacent to each of two longer edges;

a left end panel identical to the right end panel;

a first rib in the shape of a panel of substantially the same dimensions as the front panel;

a second rib identical to first rib;

a first foam rectangular frame including;

a flexible foam rectangular frame;

a rigid rectangular spacer in the shape of a frame, fitting inside and against the flexible foam rectangular frame, and of a lesser height than the flexible foam rectangular frame;

a second foam rectangular frame identical to the first foam rectangular frame;

whereby the right and left panels are coupled to the bottom panel with the right and the left panel tabs interlocking the top panel notches, and whereby the top panel is coupled to the right and left panels with the right and the left panel tabs interlocking the top panel notches; and whereby the first rib and the second rib are each disposed in the grooves in the right panel, left panel, top panel and bottom panel;

whereby the front panel is disposed into and resting on a ledge formed into the flexible foam frame, and contacting the rigid rectangular frame;

whereby the back panel is disposed into and resting on a ledge formed into the flexible foam frame, and contacting the rigid rectangular frame.

10. The athletic training box of claim 9 in which a plurality of fasteners extend through the front panel into the first rib, and through the back panel into the second rib.

11. The athletic training box of claim 10 in which the plurality of fasteners pull the front panel, and back panel against rigid rectangular spacers securing the first and second flexible foam rectangular frames.

12. The athletic training box of claim 9 in which the flexible foam rectangular frame is rounded on an outer edge.

13. The athletic training box of claim 9 further comprising:

a first pair of supports coupled to the bottom panel; and a second pair of supports coupled to the top panel.

14. The athletic training box of claim 9, in which the first foam rectangular frame, and the second foam rectangular frame are made from EVA.

15. The athletic training box of claim 9, in which the first rib, and the second rib are rectangular.

* * * * *